US007201085B1

(12) United States Patent
Hsieh

(10) Patent No.: US 7,201,085 B1
(45) Date of Patent: Apr. 10, 2007

(54) PIVOTING DEVICE FOR HAND TOOLS

(76) Inventor: Chih-Ching Hsieh, 5F.-2, No. 181, Sec. 2, Mei Tsun Rd., South District, Taichung City (TW)

( * ) Notice: Subject to any disclaimer, the term of this patent is extended or adjusted under 35 U.S.C. 154(b) by 0 days.

(21) Appl. No.: 11/332,321

(22) Filed: Jan. 17, 2006

(51) Int. Cl.
*B25B 23/16* (2006.01)

(52) U.S. Cl. ..... 81/177.1; 81/177.9; 16/900; 403/84

(58) Field of Classification Search ..... 81/177.7, 81/177.8, 177.9; 16/900, 110.1; 30/160, 30/161; 403/83–85
See application file for complete search history.

(56) References Cited

U.S. PATENT DOCUMENTS 1,144,907 A * 6/1915 Knipple ..... 81/177.9
1,175,973 A * 3/1916 Miller et al. ..... 81/119
1,182,652 A * 5/1916 Davis ..... 81/177.9
1,747,527 A * 2/1930 Peterson ..... 81/177.8
4,711,145 A * 12/1987 Inoue ..... 81/177.1
5,842,391 A * 12/1998 Chaconas ..... 81/60
6,000,302 A * 12/1999 Chiang ..... 81/177.8
6,016,726 A * 1/2000 Wright ..... 81/177.7
6,386,075 B1 * 5/2002 Shiao ..... 81/177.8
2004/0083861 A1 * 5/2004 Hu ..... 81/177.8
2005/0268753 A1 * 12/2005 Lin ..... 81/177.9

* cited by examiner

*Primary Examiner*—D. S. Meislin
(74) *Attorney, Agent, or Firm*—Rosenberg, Klein & Lee

(57) ABSTRACT

A hand tool includes a head and a pin with toothed outer periphery securely extends through two plates extending from the head. A handle has an insertion which includes an elongate slot and a plurality of teeth are defined in a first inner end of the elongate slot. The insertion is pivotably connected between the two plates of the head by the pin. A pushing member is located in the elongate slot and pushes the pin toward the first inner end of the elongate slot so that the toothed outer periphery of the pin is engaged with the teeth in the first inner end of the elongate slot to position the head. When pulling the head toward the handle, the toothed outer periphery of the pin is disengaged from the teeth in the first inner end of the elongate slot, and the head can be pivoted relative to the handle.

4 Claims, 7 Drawing Sheets

PIVOTING DEVICE FOR HAND TOOLS

FIELD OF THE INVENTION

The present invention relates to a pivoting device for pivoting the head relative to the handle and securely positions the head after being adjusted.

BACKGROUND OF THE INVENTION

A conventional hand tool such as a wrench generally includes a head and a handle wherein the head includes driving member or an engaging hole so as to be connected with an object to be tightened or loosened. The user holds and rotates the handle so as to output a torque to the object. However, the head is fixed to the handle so that the head cannot reach an object that is located in a narrow space or at an angle to a surface where the wrench can normally reach. U.S. Pat. No. 5,842,391 discloses a pivotable head of a wrench, however, the range of angles that the head can be pivoted is limited and cannot meet practical needs. U.S. Pat. No. 6,928,904 discloses a pivotable head which is connected to the handle by a pivoting device. The pivoting device includes a complicated structure and occupies a large space such that the connection portion of the handle and the head is so big that it cannot inserted into a narrow space.

The present invention intends to provide a pivoting device for hand tools wherein the head can be pivoted within a range from positive 90 degrees to negative 90 degrees, and the head can be well secured at adjusted angles.

SUMMARY OF THE INVENTION

The present invention relates to a hand tool that comprises a head having two plates and each plate has a hole defined therethrough. A handle has an insertion which includes an elongate slot and a plurality of teeth are defined in a first inner end of the elongate slot. The insertion is pivotably connected between the two plates of the connection end by a pin which securely extends through the two holes in the two plates and movably extends through the elongate slot. The pin has a toothed outer periphery. A pushing member is located in the elongate slot and pushes the pin toward the first inner end of the elongate slot to engage the toothed outer periphery of the pin with the teeth in the first inner end of the elongate slot.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
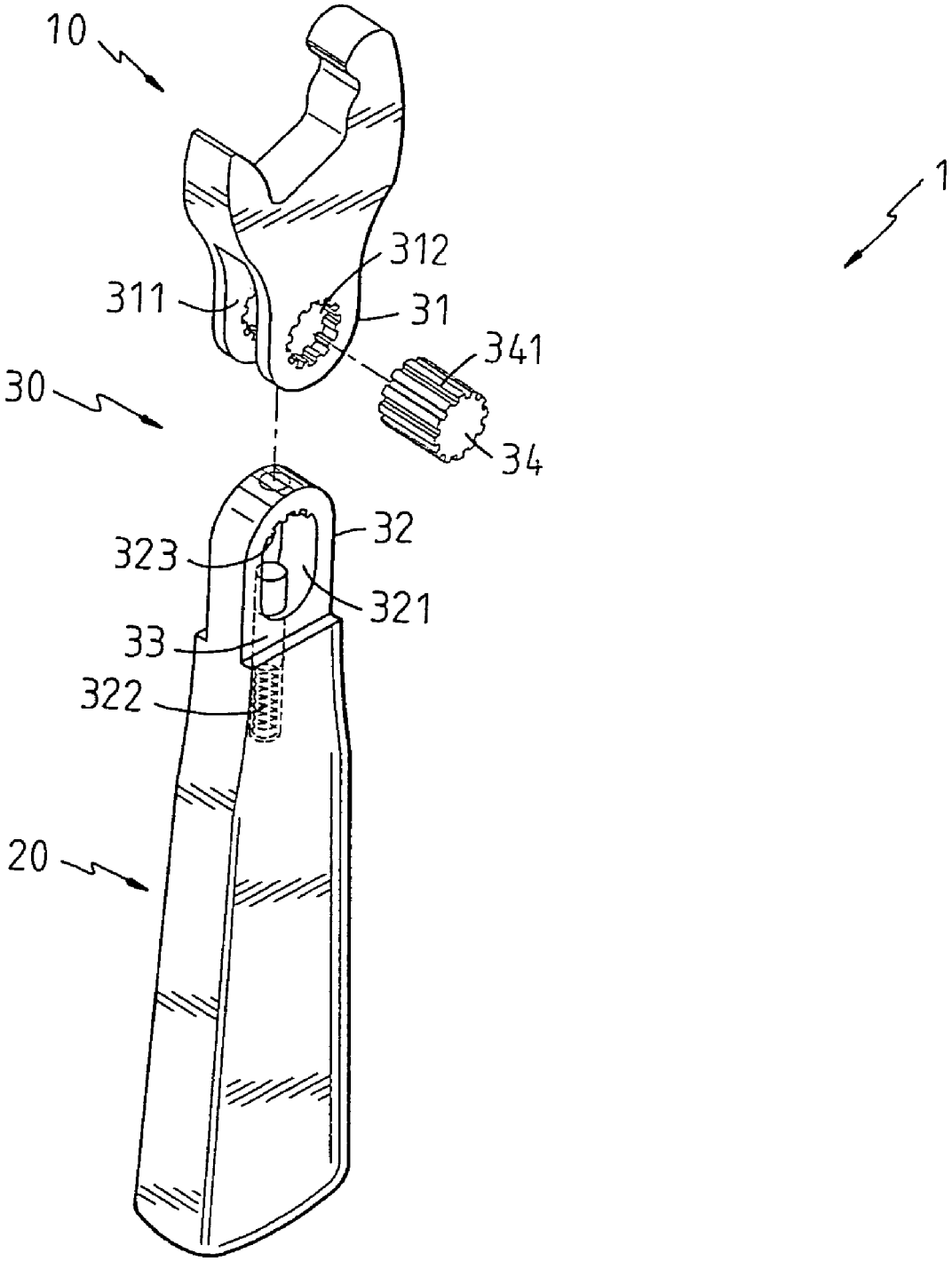
FIG. 1 is an exploded view to show the hand tool and the pivoting device of the present invention.
Figure 2:
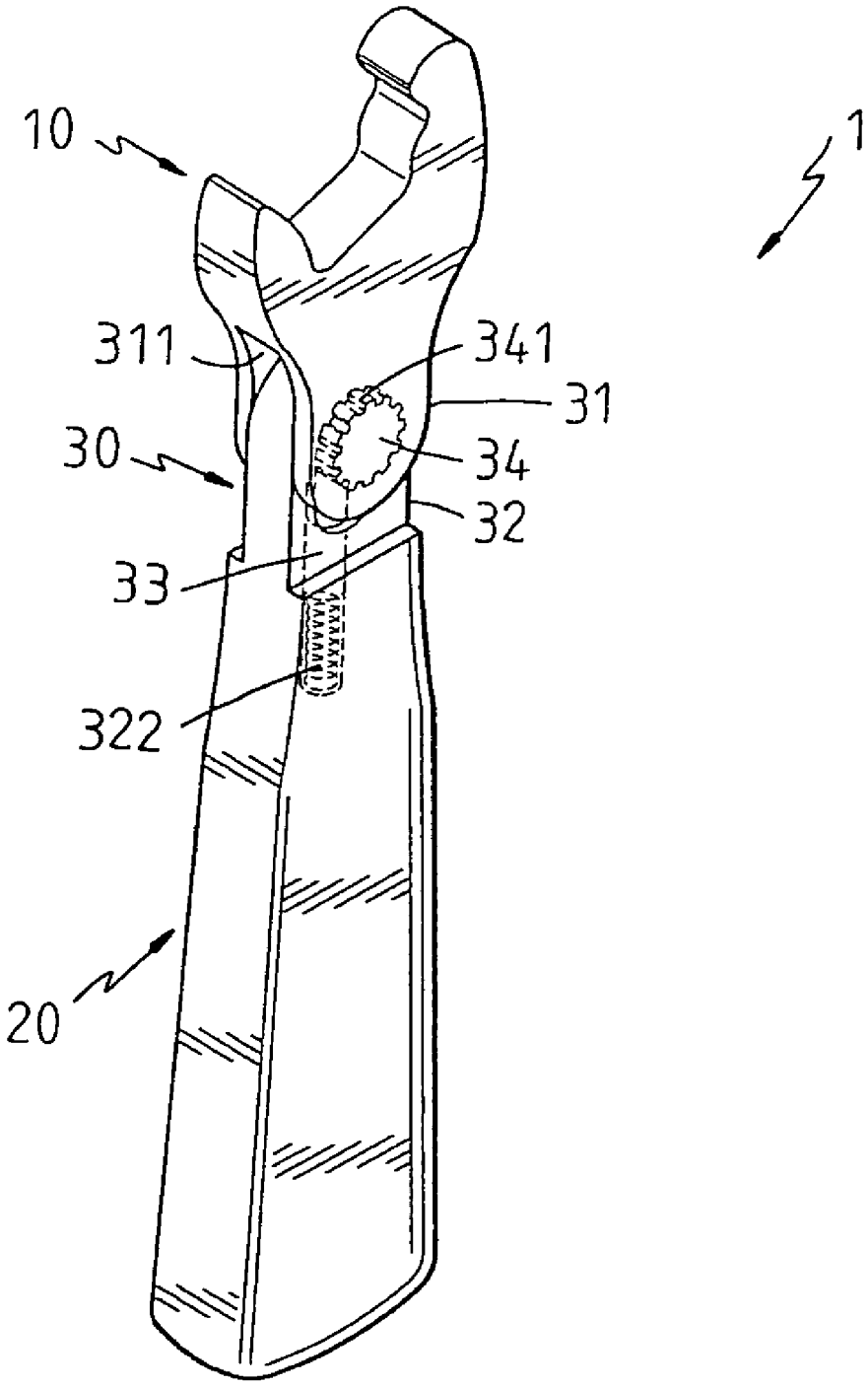
FIG. 2 is a perspective view to show the hand tool with the pivoting device of the present invention.

Referring to FIGS. 1, 2, 5 and 6, the hand tool 1 of the present invention comprises a head 10 which is a wrench head, a handle 20 and a pivoting device 30 which pivotably connects the head to the handle 20. The pivoting device 30 includes two plates 31 on the head 10, an insertion 32 on the handle 20, a pin 34 and a pushing unit 33. The head 10 has a connection end 31 which includes the two plates 311 and each plate 311 has a hole defined therethrough. The two respective holes in the two plates 311 each include an engaging inner periphery 312.

The handle 20 has the insertion 32 extending from an end thereof and the insertion 32 includes an elongate slot 321 and a plurality of teeth 323 are defined in a first inner end of the elongate slot 321. The insertion 32 is pivotably connected between the two plates 311 of the connection end 31 by the pin 34.

The pushing unit 33 includes a pushing member movably inserted in a recess 322 defined in a second inner end of the elongate slot 321 and biased by a spring received in the recess 322 so that the spring pushes the pushing member toward the first inner end of the elongate slot 321.

The pin 34 securely extends through the two holes in the two plates 311 and movably extends through the elongate slot 321. The pin 34 has a toothed outer periphery 341 and the two respective holes in the two plates 311 each include an engaging inner periphery 312 so that the toothed outer periphery 341 is engaged with the toothed outer periphery 341 and the pin 34 is secured to the two plates 311. The toothed outer periphery 341 is engaged with the teeth 323 in the first inner end of the elongate slot 321 by the pushing unit 33 so as to position the head 10.

Figure 3:
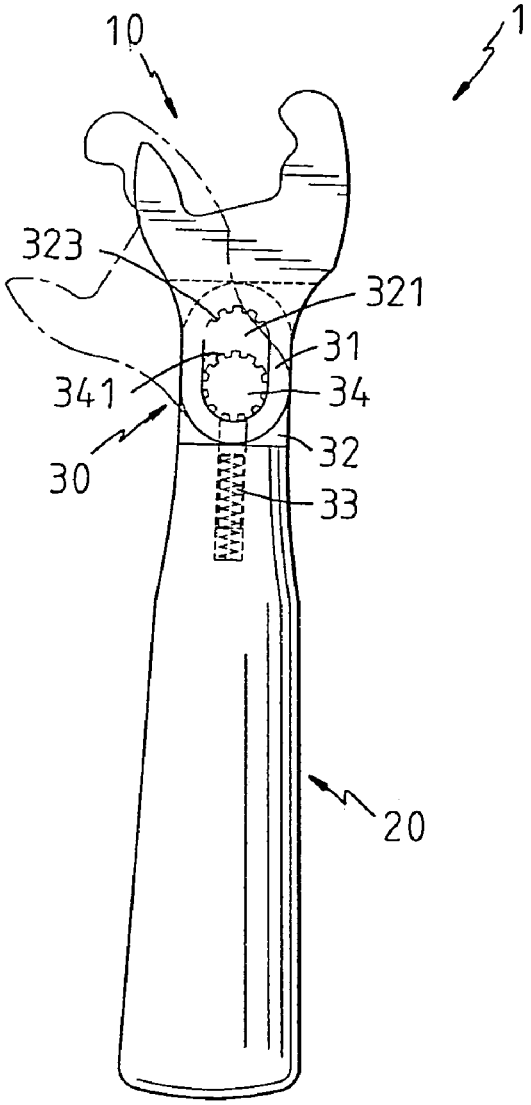
FIG. 3 shows that the head and the pin are pulled along the elongate slot to let the head be pivotable.
Figure 4:
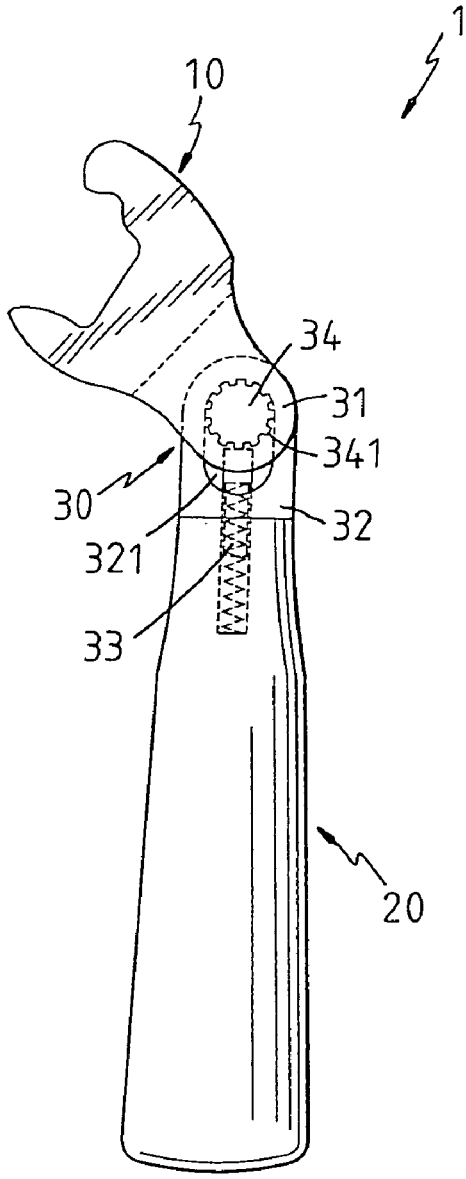
FIG. 4 shows that the head is positioned when the pin is pushed to engage with the teeth defined in the first inner end of the elongate slot.
Figure 5:
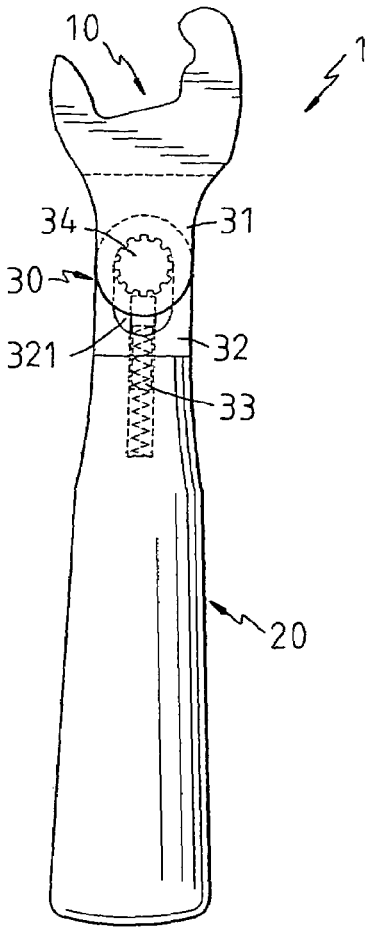
FIG. 5 is a perspective view to show that the head is positioned when the pin is pushed to engage with the teeth defined in the first inner end of the elongate slot.
Figure 6:
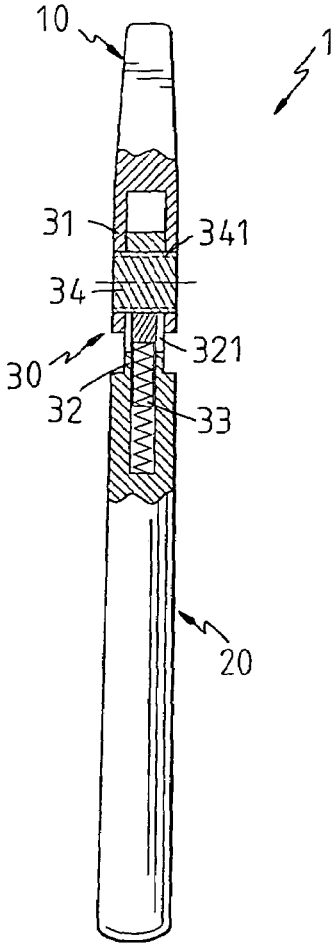
FIG. 6 is a cross sectional view to show the status in FIG. 5.
Figure 7:
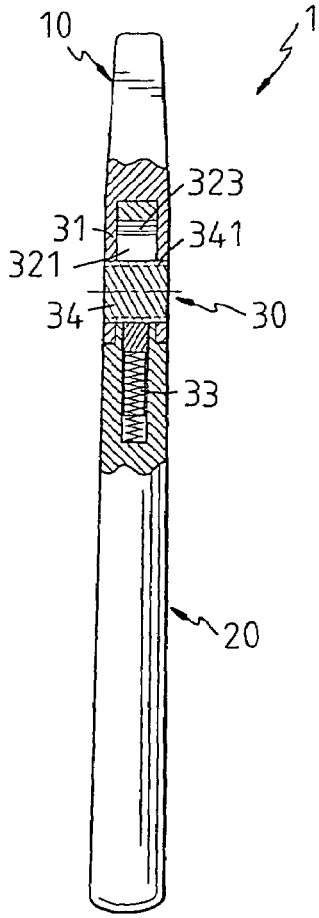
FIG. 7 is a cross sectional view to show that the pin is pulled to disengage from the teeth defined in the first inner end of the elongate slot.
Figure 8:
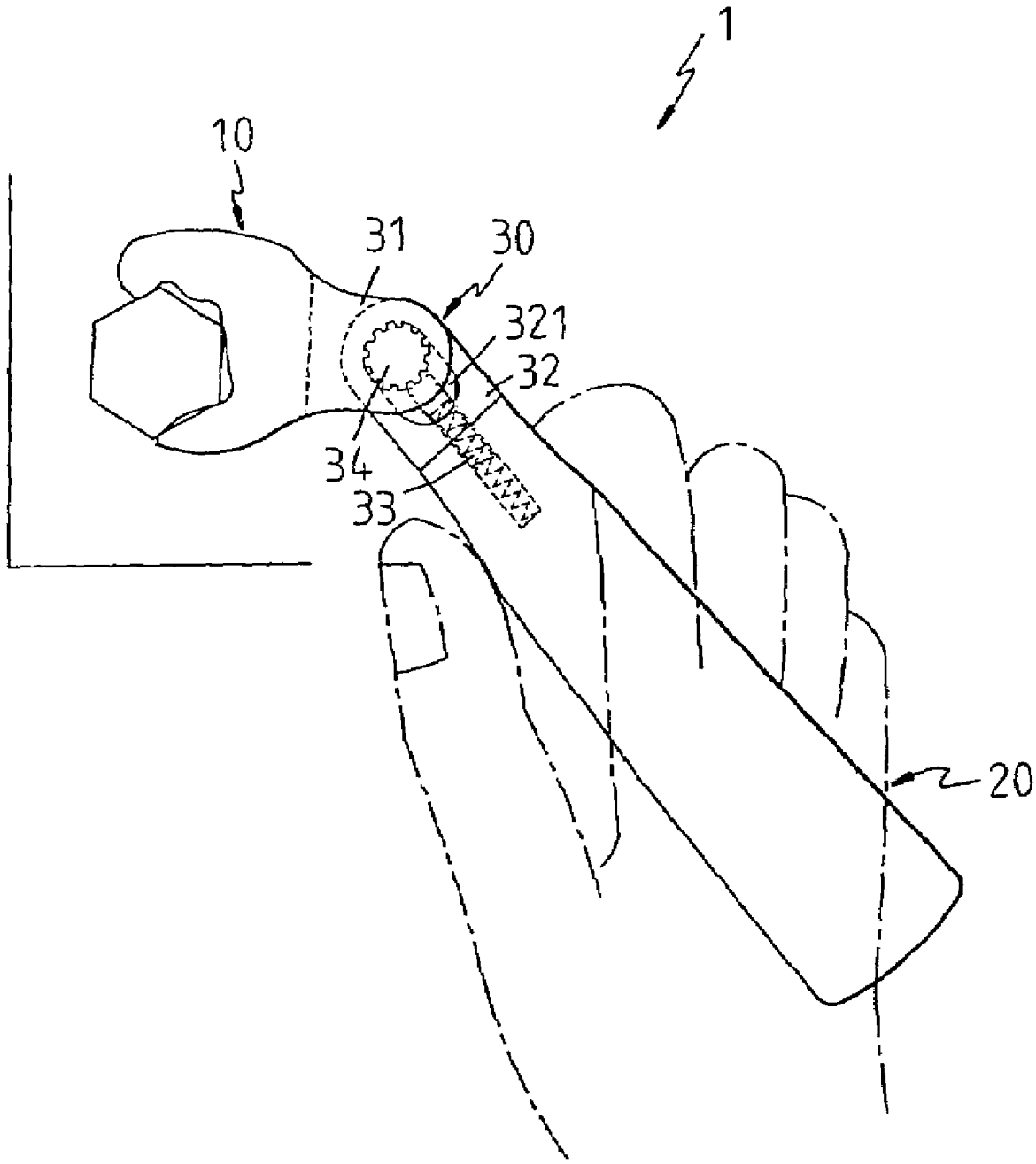
FIG. 8 shows the head is positioned at an angle and clamps an object.
Figure 9:
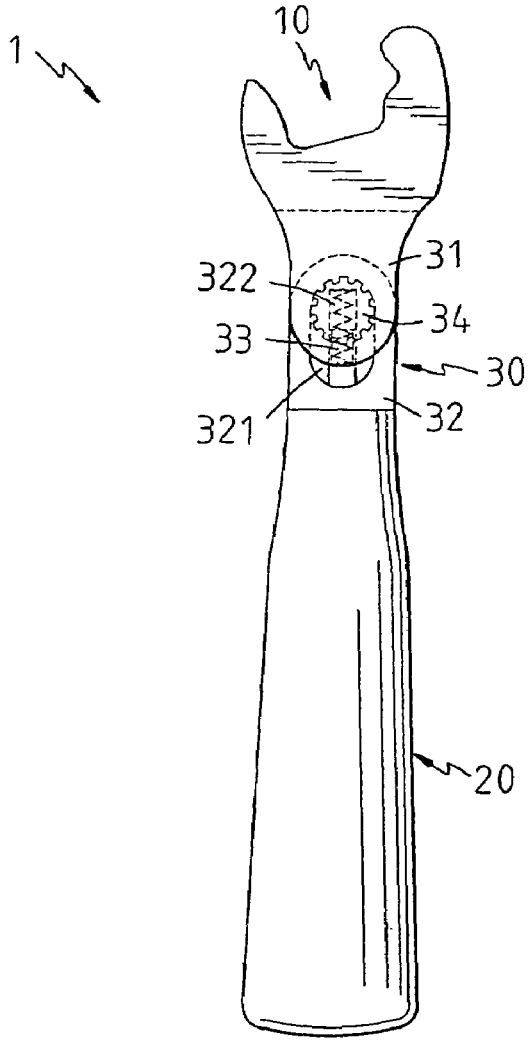
FIG. 9 shows another embodiment of the pivoting device of the present invention.
Figure 10:
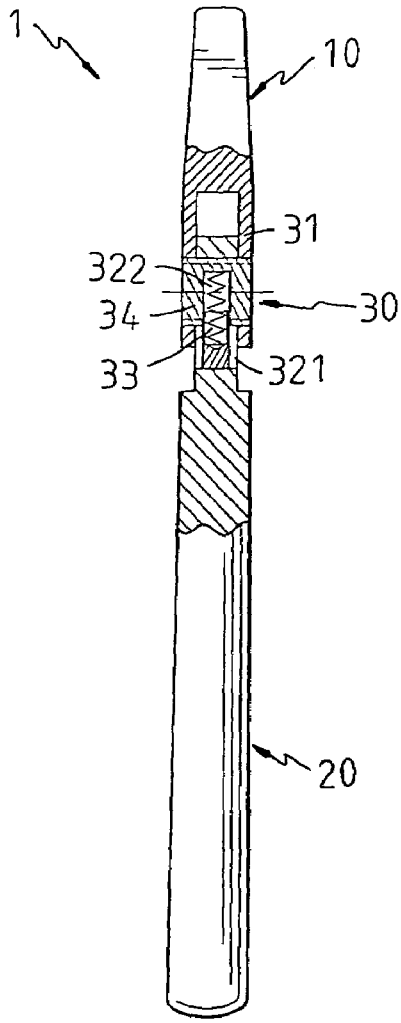
FIG. 10 is a cross sectional view to show the status in FIG. 9.
Figure 11:
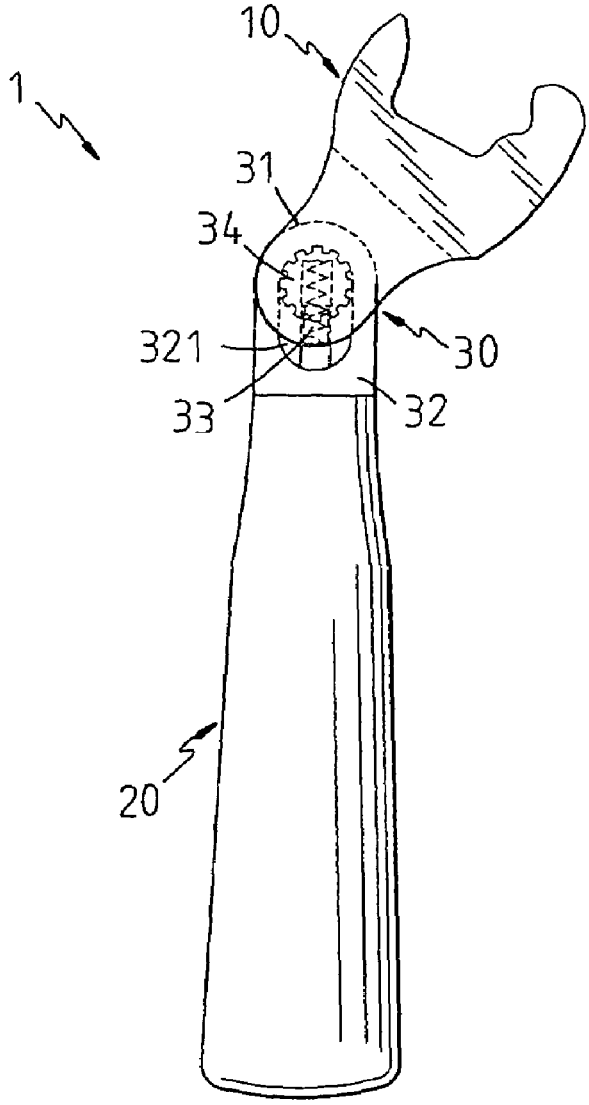
FIG. 11 shows that the head is positioned at angle.
Figure 12:
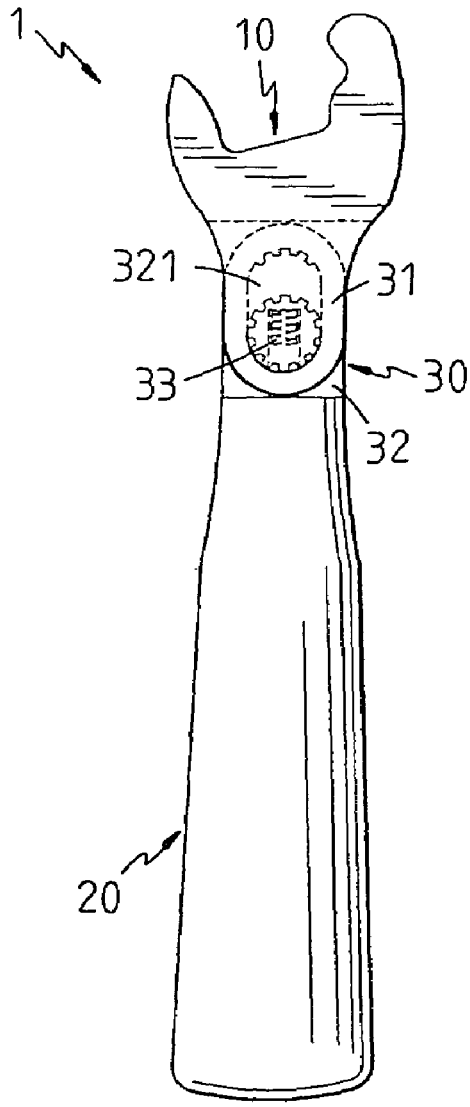
FIG. 12 shows that the head is pulled downward to disengage the pin from the teeth in the first inner end of the elongate slot.

Referring to FIGS. 3, 4 and 7, the toothed outer periphery 341 of the pin 34 can be disengaged from the teeth 323 in the first inner end of the elongate slot 321 by pulling the head 10 together with the pin 34 toward the second inner end of the elongate slot 321. When the toothed outer periphery 341 of the pin 34 is disengaged from the teeth 323 in the first inner end of the elongate slot 321, the head 10 can be pivoted relative to the handle 20. The head 10 is then released, the pushing unit 33 then pushes the pin 34 to engage with the teeth 323 in the first inner end of the elongate slot 321 to position the head 10 again. Therefore, the head 10 can be easily pivoted an angle to reach an object as shown in FIG. 8.

As shown in FIGS. 9-12, another embodiment of the pivoting device 30 includes a radial notch defined in the pin 34 and a spring is received in the radial notch in the pin 34.

A pushing unit 33 includes a pushing member which has an end connected to the second inner end of the elongate slot 321 and the other end of the pushing member is connected to the spring so as to push the pin 34 to engage with the teeth 323 in the first inner end of the elongate slot 321.

While we have shown and described the embodiment in accordance with the present invention, it should be clear to those skilled in the art that further embodiments may be made without departing from the scope of the present invention.

What is claimed is:

1. A hand tool 1 comprising:

a head 10 having a connection end 31 which includes two plates 311 and each plate 311 having a hole defined therethrough;

a handle 20 having an insertion 32 which includes an elongate slot 321 and a plurality of teeth 323 defined in a first inner end of the elongate slot 321, the insertion 32 pivotably connected between the two plates 311 of the connection end 31;

a pin 34 securely extending through the two holes in the two plates 311 and movably extending through the elongate slot 321, the pin 34 having a toothed outer periphery 341, and a pushing member 33 located in the elongate slot 321 and pushing the pin 34 toward the first inner end of the elongate slot 321 to engage the toothed outer periphery 341 of the pin 34 with the teeth 323 in the first inner end of the elongate slot 321.

2. The hand tool as claimed in claim 1, wherein a recess 322 is defined in a second inner end of the elongate slot 321 and the pushing member 33 being biased by a spring received in the recess 322 so that the pushing member 33 is displaced toward the first inner end of the elongate slot 321.

3. The hand tool as claimed in claim 1, wherein the two respective holes in the two plates 311 each include an engaging inner periphery 312 which is engaged with the toothed outer periphery 341 so that the pin 34 is secured to the two plates 311.

4. The hand tool as claimed in claim 1, wherein the pin 34 includes a radial notch and a spring is received in the radial notch in the pin 34 and a pushing member 33 has an end connected to the second inner end of the elongate slot 321 and the other end of the pushing member 33 is connected to the spring to push the pin 34 to engage with the teeth 323 in the first inner end of the elongate slot 321.

* * * * *